US010052739B2

(12) United States Patent
Gajendra et al.

(10) Patent No.: US 10,052,739 B2
(45) Date of Patent: Aug. 21, 2018

(54) CARRIER HEAD WITH COMPOSITE PLASTIC PORTIONS

(75) Inventors: Manoj A. Gajendra, Bangalore (IN); Kiran Giriyapura, Bangalore (IN)

(73) Assignee: Applied Materials, Inc., Santa Clara, CA (US)

( * ) Notice: Subject to any disclaimer, the term of this patent is extended or adjusted under 35 U.S.C. 154(b) by 235 days.

(21) Appl. No.: 13/560,636

(22) Filed: Jul. 27, 2012

(65) Prior Publication Data

US 2013/0065495 A1 Mar. 14, 2013

Related U.S. Application Data

(60) Provisional application No. 61/533,687, filed on Sep. 12, 2011.

(51) Int. Cl.
*B24B 37/32* (2012.01)
*B24B 37/30* (2012.01)

(52) U.S. Cl.
CPC ..... *B24B 37/30* (2013.01)

(58) Field of Classification Search
CPC ..... B24B 41/06; B24B 37/32; B24B 37/30; H01L 21/30625
USPC ..... 451/365, 288, 290
See application file for complete search history.

(56) References Cited

U.S. PATENT DOCUMENTS 5,473,989 A * 12/1995 Buc ..... 102/521
5,738,574 A * 4/1998 Tolles et al. ..... 451/288
5,916,412 A * 6/1999 Nakashiba et al. ..... 156/345.14
6,019,670 A * 2/2000 Cheng et al. ..... 451/56
6,056,632 A * 5/2000 Mitchel et al. ..... 451/288
6,183,354 B1 * 2/2001 Zuniga et al. ..... 451/285
6,361,419 B1 * 3/2002 Zuniga et al. ..... 451/287
6,474,869 B1 * 11/2002 Sommerfeld et al. ..... 384/222
6,602,114 B1 * 8/2003 Wang et al. ..... 451/41
6,602,116 B1 * 8/2003 Prince ..... 451/51
6,621,264 B1 * 9/2003 Lehman et al. ..... 324/230
6,857,945 B1 * 2/2005 Chen et al. ..... 451/288
6,872,130 B1 * 3/2005 Zuniga ..... 451/287
6,890,249 B1 * 5/2005 Zuniga et al. ..... 451/398
(Continued)

FOREIGN PATENT DOCUMENTS

CN 102172886 9/2011
CN 102172887 9/2011
(Continued)

OTHER PUBLICATIONS

International Search Report and Written Opinion in International Application No. PCT/US2012/048672, dated Feb. 27, 2013, 12 pages.

(Continued)

*Primary Examiner* — Christopher M Koehler
*Assistant Examiner* — Brian Keller
(74) *Attorney, Agent, or Firm* — Fish & Richardson P.C.

(57) ABSTRACT

A chemical mechanical polishing head includes a base assembly that includes at least one component formed of a composite plastic having a tensile modulus approximately equal to or greater than aluminum, a retaining ring secured to the base assembly, and a flexible membrane secured to the base assembly to form a pressurizable chamber between the base assembly and an upper surface of the flexible membrane. A lower surface of the flexible membrane provides a substrate mounting surface.

14 Claims, 2 Drawing Sheets

(56) References Cited

U.S. PATENT DOCUMENTS

| | | | | |
|---|---|---|---|---|
| 6,945,845 | B2 | 9/2005 | Bennett et al. | |
| 7,044,838 | B2 * | 5/2006 | Maloney et al. | 451/41 |
| 7,311,586 | B2 * | 12/2007 | Maloney et al. | 451/41 |
| 7,520,955 | B1 * | 4/2009 | Zuniga et al. | 156/345.14 |
| 7,654,888 | B2 * | 2/2010 | Zuniga et al. | 451/398 |
| 7,699,688 | B2 * | 4/2010 | Zuniga et al. | 451/442 |
| 2004/0176014 | A1 * | 9/2004 | Bennett et al. | 451/5 |
| 2005/0215182 | A1 * | 9/2005 | Fuhriman et al. | 451/41 |

FOREIGN PATENT DOCUMENTS

| | | |
|---|---|---|
| TW | 548162 | 8/2003 |
| TW | I279288 | 4/2007 |
| TW | 201201957 | 1/2012 |
| TW | 481597 | 4/2015 |

OTHER PUBLICATIONS

Chinese Office Action in Chinese Application No. 201280051111.4, dated Nov. 11, 2015, 11 pages (English Search Report).
Taiwan Office Action in Taiwan Application No. 101128460, dated Sep. 23, 2016, 9 pages (English Search Report).

* cited by examiner

CARRIER HEAD WITH COMPOSITE PLASTIC PORTIONS

CROSS-REFERENCE TO RELATED APPLICATIONS

This application claims priority to U.S. Provisional Application Ser. No. 61/533,687, filed on Sep. 12, 2011.

TECHNICAL FIELD

The present disclosure relates to a carrier head for chemical mechanical polishing.

BACKGROUND

Integrated circuits are typically formed on substrates, particularly silicon wafers, by the sequential deposition of conductive, semiconductive or insulative layers. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as a slurry with abrasive particles, is typically supplied to the surface of the polishing pad. For polishing of a metal layer on a substrate, e.g., a copper layer, the slurry can be acidic.

SUMMARY

The internal components of a carrier head are typically formed of a metal, e.g., aluminum, to provide rigidity for the retaining ring. However, during polishing of a metal layer on a substrate, the acidic slurry can reach the internal aluminum components and cause corrosion. To address this problem, some internal components can be formed of a composite plastic with a tensile modulus comparable or greater than aluminum.

In one aspect, a chemical mechanical polishing head includes a base assembly that includes at least one component formed of a composite plastic having a tensile modulus approximately equal to or greater than aluminum, a retaining ring secured to the base assembly, and a flexible membrane secured to the base assembly to form a pressurizable chamber between the base assembly and an upper surface of the flexible membrane. A lower surface of the flexible membrane providing a substrate mounting surface.

Implementations may include one or more of the following features. The plastic may be substantially inert to slurry for copper polishing. The composite plastic may be a glass-filled plastic. The composite plastic may include polyphenylene sulfide (PPS) or polyetheretherketone (PEEK). The composite plastic may be glass-filled polyphenylene sulfide (PPS) or glass-filled polyetheretherketone (PEEK). The retaining ring may include an upper portion of stainless steel and a lower portion of a plastic. The base assembly may include a stainless steel clamp ring. The base assembly may include a clamp ring that consists of polyetheretherketone. A portion of the flexible membrane may be clamped between the a stainless steel clamp ring and the clamp ring that consists of polyetheretherketone. The base assembly may include a clamp ring that consists of polyphenylene sulfide (PPS). A portion of the flexible membrane may be clamped between the clamp ring that consists of polyetheretherketone and the clamp ring that consists of polyphenylene sulfide (PPS).

In another aspect, a polishing system includes a polishing pad support to hold a polishing pad with a polishing surface, a carrier head having a base assembly, a flexible membrane to hold a substrate against the polishing surface, and an eddy current monitoring system including a sensor head positioned to generate a magnetic field that passes through the polishing pad and extends into the carrier head. The base assembly may include at least one component having at least a portion positioned within the magnetic field and that is formed of a composite plastic having a tensile modulus approximately equal to or greater than aluminum.

Implementations can include one or more of the following advantages. In particular, a composite plastic may be more resistant to corrosion, e.g., from slurry used for polishing of a metal layer, e.g., copper, on a substrate, which may reduce defects and improve carrier head lifetime. In addition, the composite plastic components may maintain the overall rigidity of the retaining ring so that the retaining ring maintains a generally flat contour when secured to the carrier head, thereby maintaining polishing uniformity. Forming the internal components of a composite plastic may result in less noise during monitoring of polishing of a substrate with an eddy current monitoring system, which may improve endpoint detection.

The details of one or more implementations are set forth in the accompanying drawings and the description below. Other aspects, features, and advantages will be apparent from the description and drawings, and from the claims.

DETAILED DESCRIPTION

During a polishing operation, one or more substrates can be polished by a chemical mechanical polishing (CMP) apparatus that includes a carrier head 100. A description of a CMP apparatus can be found in U.S. Pat. No. 5,738,574.

Figure 1:
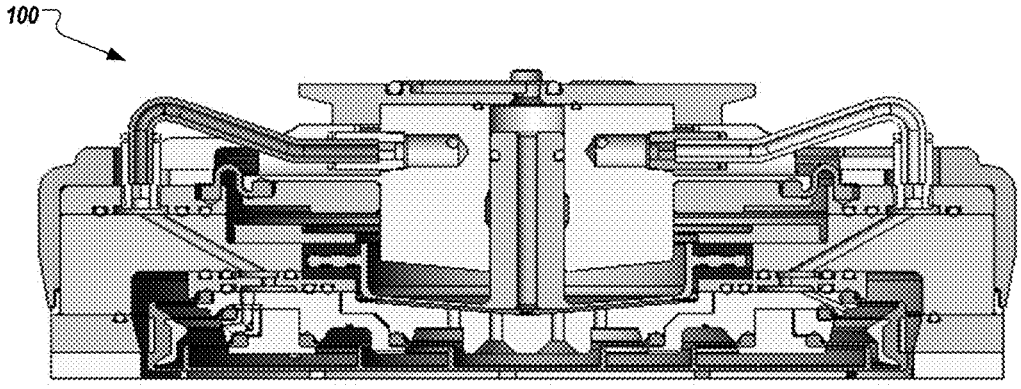
FIG. 1 is a schematic cross-sectional view of a carrier head for a chemical mechanical polishing apparatus.
Figure 2:
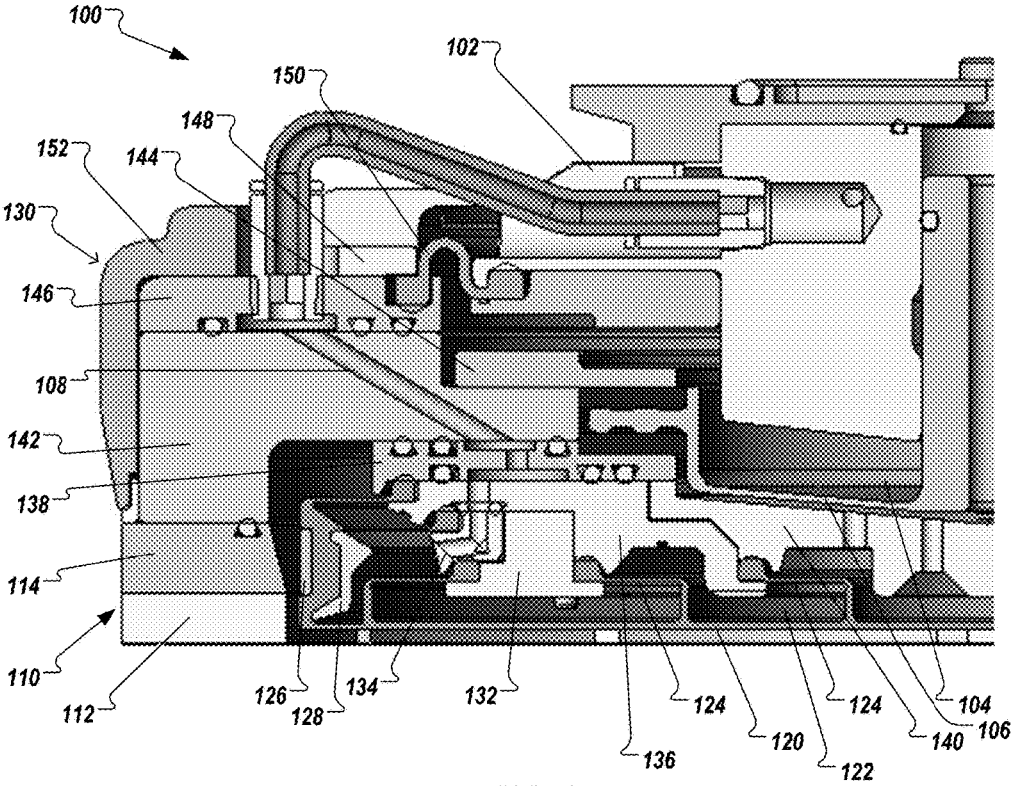
FIG. 2 is an enlarged view of the left hand side of the carrier head of FIG. 1.
Figure 3:
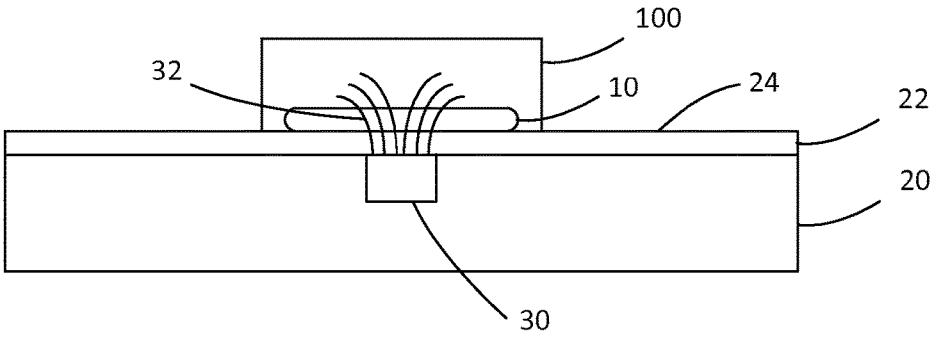
FIG. 3 is a schematic cross-sectional view of a polishing system.

Referring to FIGS. 1 and 2, an exemplary carrier head 100 includes a housing 102, a base assembly 130 that is vertically movable relative to the housing 102, a gimbal mechanism 106, a pressurizable chamber 104 between the housing 102 and the base assembly 130 that controls the vertical position or downward pressure on the base assembly 130, a flexible membrane 120 secured to the base assembly 130 with a bottom surface that provides a mounting surface for the substrate, one or more pressurizable chambers 122 between the membrane 120 and the base assembly 130, and a retaining ring 110 secured near the edge of the base assembly 130 to hold the substrate below membrane 120. The housing 102 can be secured to a drive shaft, and the drive shaft can rotate and/or translate the carrier head across a polishing pad.

The retaining ring 110 may be a generally annular ring secured at the outer edge of the base assembly 130, e.g., by screws or bolts that extend through aligned passages in the base assembly 130 into the upper surface of the retaining ring 110. An inner surface of the retaining ring 110 defines, in conjunction with the lower surface of the flexible membrane 120, a substrate receiving recess. The retaining ring 110 prevents the substrate from escaping the substrate receiving recess. The retaining ring 110 can include a lower portion 112 and an upper portion 114 that is more rigid than the lower portion 112. The lower portion 112 can be a plastic, such as polyphenylene sulfide (PPS) or polyetheretherketone (PEEK). The lower portion 112 can be substantially pure plastic (consist of plastic), e.g., no non-plastic fillers. The upper portion 114 can be a metal, e.g., stainless steel.

A pump can be fluidly connected to the chamber 104 through a passage in the housing 102 and/or base assembly 130 to control the pressure in the chamber 104 and thus the position of and/or downward pressure on the base assembly 130, and thus the retaining ring 110. Similarly, pumps can be fluidly connected to the chambers 122 through passages 108 in the housing 102 and/or base assembly 130 to control the pressures in the chambers 122 and thus the downward pressures of the flexible membrane 120 on the substrate.

Alternatively, the base assembly 130 and the housing 102 could be combined into a single part (with no chamber 122 and the base assembly 130 not vertically movable relative to the housing 102). In some of these implementations, the drive shaft 120 can be raised and lowered to control the pressure of the retaining ring 110 on the polishing pad. In another alternative, the retaining ring 110 can be movable relative to the base assembly 130 and the carrier head 100 can include an internal chamber which can be pressurized to control a downward pressure on the retaining ring, e.g., as described in U.S. Pat. No. 7,699,688, which is incorporated by reference.

The flexible membrane 120 can be a silicone membrane. The flexible membrane can include multiple flaps 124 that divide the volume between the flexible membrane 120 and the base assembly 104 into individually controllable chambers. The ends of the flaps 124 can be attached to the base assembly 130, e.g., clamped to the base assembly 130. An annular external ring 126 can be inset into a recess in the outer surface of the outer perimeter portion of the flexible membrane 120. An annular internal ring 128 can abut the inner surface of the outer perimeter portion of the flexible membrane 120. The external ring 126 and internal ring 128 increase the rigidity of the perimeter portion of the flexible membrane 120. This can permit pressure in an upper chamber of the multiple chambers to be transmitted through the perimeter portion to the substrate.

The base assembly 130 can include multiple components. The end of one of the flaps 124 can be clamped between a first clamp 132 and a second clamp 134 that is positioned above and abutting the first clamp 132. The first clamp 132 can be a substantially pure plastic, e.g., polyetheretherketone (PEEK) without fillers. The second clamp 134 can be a substantially pure plastic, but can be a different plastic than the plastic of the first clamp, e.g., polyphenylene sulfide (PPS). The end of another of the flaps 124 can be clamped between a first clamp 132 and a third clamp 136 that is positioned above and abutting both the first clamp 132 and the second clamp 134. The third clamp 136 can be a substantially pure plastic, but can be a different plastic than the plastic of the second clamp. In addition, the third clamp 136 can be the same plastic as the first clamp 132. For example, the third clamp can be polyphenylene sulfide (PPS). The end of yet another of the flaps 124 can be clamped between the third clamp 136 and a fourth clamp 138 that is positioned above and abutting the third clamp 136. The fourth clamp 138 can be a metal, e.g., stainless steel. The end of still another of the flaps 124 can be clamped between the third clamp 136 and a generally disk-shaped body 140 near the middle of the carrier head that extends over part of the second clamp 136. The generally disk-shaped body 140 can be a substantially pure plastic, e.g., polyphenylene sulfide (PPS). An advantage of the substantially pure plastic for the clamps 132, 134, 136 and the body 140 is ease of machining of fairly complex shapes.

The top of the fourth clamp 138 can be secured to and abut the underside of a fifth clamp 142. The retaining ring 110 can also be secured to and abut the underside of the fifth clamp 142. The fifth clamp 142 can be a composite plastic, e.g., a glass filled polyphenylene sulfide (PPS) or glass-filled polyetheretherketone (PEEK), e.g., 30-50% glass, e.g., 40% glass. An advantage of the composite plastic (and in particular the glass-filled plastic), is that these materials can have a tensile modulus comparable or greater than aluminum. Thus, the fifth clamp 142 can be more resistant than aluminum to corrosion, e.g., from slurry used for polishing of a metal layer, e.g., copper, on a substrate, while maintaining the overall rigidity of the retaining ring, thereby maintaining polishing uniformity A sixth clamp 144 can be placed above and abutting the fifth clamp 142. An outer edge of the gimbal mechanism 106 can be clamped between the fourth clamp 138 and the sixth clamp 144. The gimbal mechanism (which can be considered part of the base assembly 130) permits the base assembly 130 to slide vertically relative to the housing 102 while restricting lateral motion of the base assembly 130. The sixth clamp 144 can be metal, e.g., stainless steel. An advantage of metal, e.g., stainless steel, for the fourth clamp 138 and the sixth clamp 144 is secure attachment of the gimbal mechanism.

A seventh clamp 146 can be placed above and abutting the fifth clamp 142. The seventh clamp 146 can be stainless steel. An outer edge of a membrane 150 that seals the chamber 104 can be clamped between the seventh clamp 146 and an eighth clamp 148. A cover 152, e.g., formed of semi-crystalline thermoplastic polyester based on polyethyleneterephthalate (PET-P), e.g., Ertalyte™, can be draped over the seventh clamp 146 and extend along the outer side wall of the fifth clamp 142.

Together, the gimbal mechanism 106, body 140, clamps 132-148 and cover 152, can be considered to provide the base assembly 130. However, there are many alternative implementations that can still use the techniques set out in this disclosure. For example, there can fewer flaps 124 on the membrane 120, so that some of the clamps become extraneous are not part of the carrier head. Or, there could be more flaps 124 on the membrane 120, so that additional clamps are needed. Relative positions of some of the clamps can be changed, and some clamps can be combined into single unitary parts.

A polishing system includes a polishing pad support 20 to hold a polishing pad 22 with a polishing surface 24, the carrier head 100, and an eddy current monitoring system including a sensor head 30 positioned to generate a magnetic field 32 that passes through the polishing pad 22 and extends into the carrier head 100. Since nearly all of the internal components of the carrier head 100 are formed of non-conductive, non-magnetic materials, there can be less noise during monitoring of polishing of a substrate 10 with the eddy current monitoring system, which may improve end-point detection.

The present invention has been described in terms of a number of embodiments. The invention, however, is not limited to the embodiments depicted and described. Rather, the scope of the invention is defined by the appended claims.

What is claimed is:

1. A chemical mechanical carrier head, comprising:

a base assembly that includes at least one component that is a composite plastic having a tensile modulus approximately equal to or greater than aluminum, a gimbal, a first plurality of clamp rings that are substantially pure plastic, and a second plurality of clamp rings that are metal;

a retaining ring secured to the base assembly; and a flexible membrane secured to the base assembly to form a plurality of pressurizable chambers between the base assembly and an upper surface of the flexible membrane, a lower surface of the flexible membrane providing a substrate mounting surface, the flexible membrane including a plurality of flaps, the plurality of flaps including an outer edge flap to provide an outer boundary of an outermost of the pressurizable chambers and a plurality of inner flaps to provide boundaries between the plurality of pressurizable chambers, wherein at least a first portion of the at least one component is positioned over the retaining ring with the retaining ring secured to and abutting the first portion of the at least one component and at least a second portion of the at least one component is positioned radially inward of the retaining ring and extends over the flexible membrane, wherein the second plurality of clamp rings comprise a pair of metal clamps positioned entirely radially inward of the first portion and abutting opposite upper and lower surfaces of the second portion with an outer edge of the gimbal clamped between the pair of metal clamps, wherein the first plurality of clamp rings formed of substantially pure plastic are positioned entirely radially inward of the retaining ring between the at least one component and the flexible membrane and are secured to the second portion of the at least one component in a vertically fixed position relative to the at least one component, and wherein the plurality of inner flaps are clamped between the first plurality of clamp rings that are substantially pure plastic with each inner flap of the plurality of inner flaps clamped between a respective pair of clamp rings of the first plurality of clamp rings that are substantially pure plastic and the each inner flap having a respective first side contacting a respective first clamp ring of the respective pair of clamp rings and a respective second side contacting a respective second clamp ring of the respective pair of clamp rings.

2. The carrier head of claim 1, wherein the composite plastic is a glass-filled plastic.

3. The carrier head of claim 2, wherein the composite plastic is glass-filled polyphenylene sulfide (PPS) or glass-filled polyetheretherketone (PEEK).

4. The carrier head of claim 1, wherein the composite plastic comprises polyphenylene sulfide (PPS) or polyetheretherketone (PEEK).

5. The carrier head of claim 1, wherein the retaining ring comprises an upper portion of stainless steel and a lower portion of a plastic.

6. The carrier head of claim 1, wherein the pair of metal clamps comprises a stainless steel clamp ring positioned entirely radially inward of the retaining ring below the at least one component and is secured to the at least one component in a vertically fixed position relative to the at least one component.

7. The carrier head of claim 6, wherein the first plurality of clamp rings that are substantially pure plastic include a clamp ring that consists of polyetheretherketone.

8. The carrier head of claim 7, wherein the outer edge flap of the flexible membrane is clamped between the stainless steel clamp ring and the clamp ring that consists of polyetheretherketone.

9. The carrier head of claim 1, wherein the first plurality of clamp rings that are substantially pure plastic include a clamp ring that consists of polyphenylene sulfide and a clamp ring that consists of polyetheretherketone.

10. The carrier head of claim 9, wherein at least one inner flap of the plurality of inner flaps of the flexible membrane is clamped between the clamp ring that consists of polyetheretherketone and the clamp ring that consists of polyphenylene sulfide.

11. The carrier head of claim 1, wherein the first plurality of clamp rings comprise a first clamp ring, a second clamp ring, and a third clamp ring.

12. The carrier head of claim 11, wherein a first flap of the plurality of inner flaps is clamped between the first clamp ring and the second clamp ring.

13. The carrier head of claim 12, wherein a second flap of the plurality of inner flaps is clamped between the second clamp ring and the third clamp ring.

14. The carrier head of claim 13, wherein a third flap of the plurality of inner flaps is clamped between the first clamp ring and the third clamp ring.

* * * * *